United States Patent [19]

Mader

[11] 4,021,047

[45] May 3, 1977

[54] GOLF DRIVER CLUB

[76] Inventor: Robert J. Mader, 1218 Arlington Ave., Torrance, Calif. 90501

[22] Filed: Feb. 25, 1976

[21] Appl. No.: 661,324

[52] U.S. Cl. ..... 273/167 H

[51] Int. Cl.[2] ..... A63B 53/04

[58] Field of Search ..... 273/77 R, 167–175

[56] References Cited

UNITED STATES PATENTS

| | | | |
|---|---|---|---|
| 1,526,438 | 2/1925 | Scott | 273/174 X |
| 1,616,920 | 2/1927 | Pedersen | 273/174 X |
| 2,171,383 | 8/1939 | Wettlaufer | 273/171 |
| 2,859,972 | 11/1958 | Reach | 273/167 F X |
| 3,637,218 | 1/1972 | Carlino | 273/167 H X |

*Primary Examiner*—Richard J. Apley
*Attorney, Agent, or Firm*—Edward A. Sokolski

[57] ABSTRACT

The head of a golf driver club is formed from a one-piece casting having a face plate portion, a sole plate portion and toe and heel wall portions with a concavity being formed between these portions. A cap which is preferably of wood or plastic encloses this concavity to form an air chamber within the club head. This cap is fitted onto the casting portion by means of a lip which fits under an edge of the casting, the cap being fastened to the sole plate.

6 Claims, 6 Drawing Figures

GOLF DRIVER CLUB

This invention relates to golf driver clubs, and more particularly to a head for such a club formed from a one-piece metal casting with a cap being attached to the casting to form a hollow chamber in the club.

In recent years, it has been found advantageous to fabricate golf club drivers by casting a substantial portion of the club head structure. It is particularly advantageous to form the face and sole plates in a single solid piece to provide a good solid feel to the club. In clubs of this type of the prior art, the top and central portions of the club have generally been formed with a solid piece of plastic or wood which totally fills the central portions of the club head. The present invention is an improvement over such prior art cast driver heads in that rather than utilizing a solid central portion, a cap is rather formed preferably from a piece of wood or plastic, this cap being fitted between the face plate, the sole plate, and toe and heel portions of the head, to enclose a concavity formed between these parts. Thus, the central portions of the club head are hollow, while the face plate, sole plate and toe and heel portions of the head are formed in a unitary solid piece. This gives the club a good solid feel on contact with the ball, with the hollow cavity providing a psychologically reinforcing sound. Further, the fabrication of the club in this fashion greatly simplifies assembly and makes for more economical construction.

Referring now to the drawings.

Figure 2:
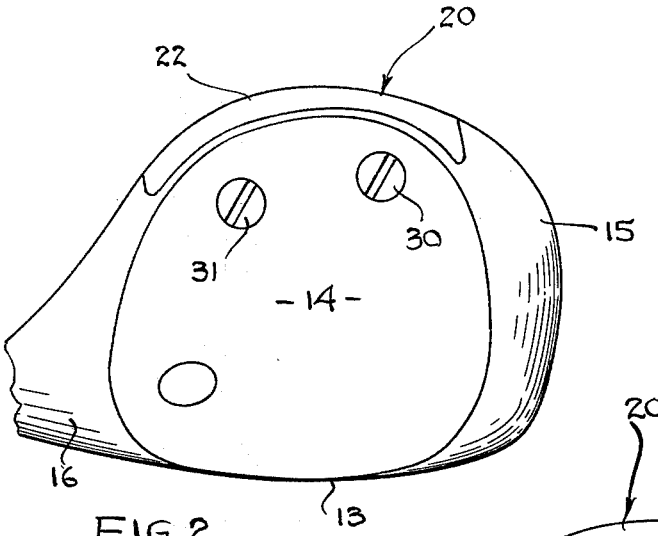
FIG. 2 is a bottom plan view of the preferred embodiment.
Figure 1:
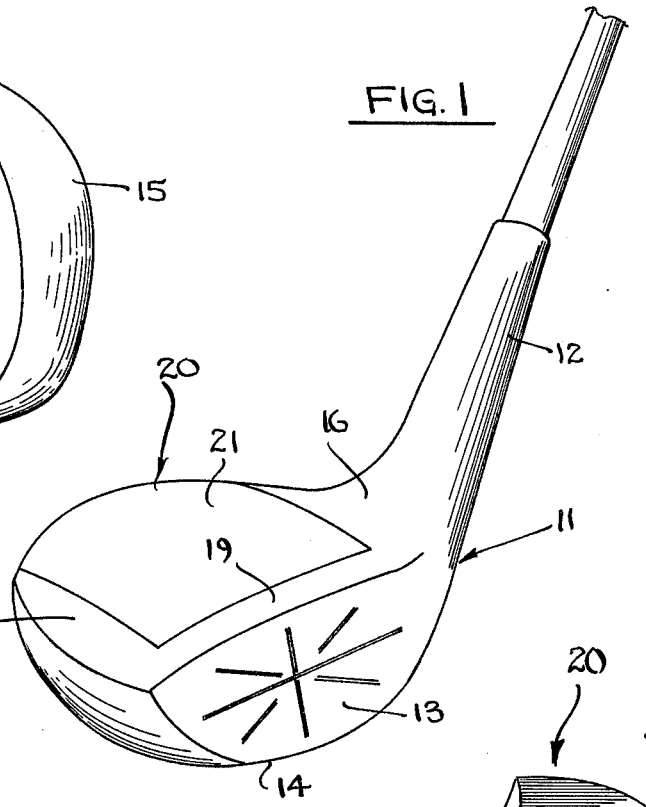
FIG. 1 is a perspective view of a preferred embodiment of the invention.
Figure 3:
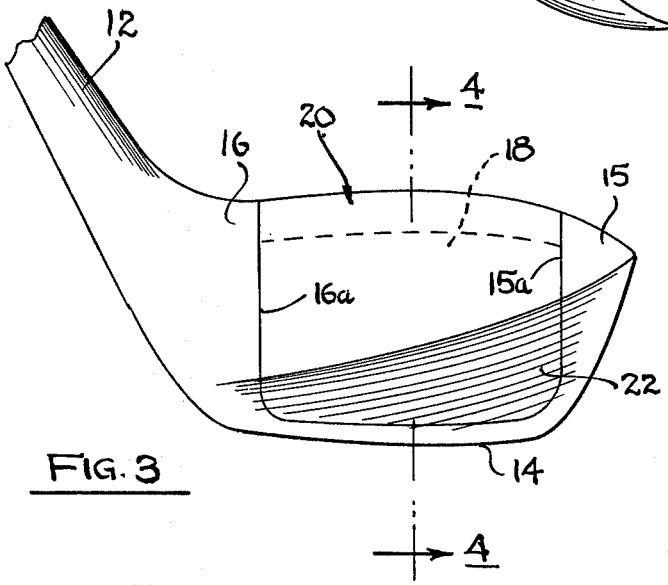
FIG. 3 is a side elevational view of the preferred embodiment.
Figure 5:
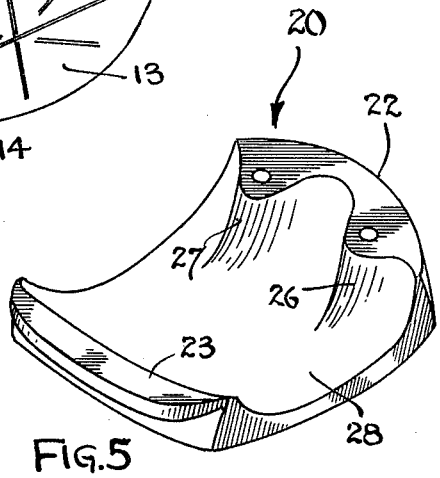
FIG. 5 is a perspective view of the cap of the preferred embodiment.
Figure 4:
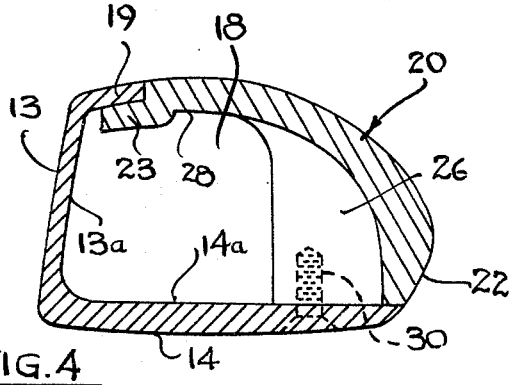
FIG. 4 is a cross-sectional view taken along the plane indicated by 4—4 in FIG. 3.
Figure 6:
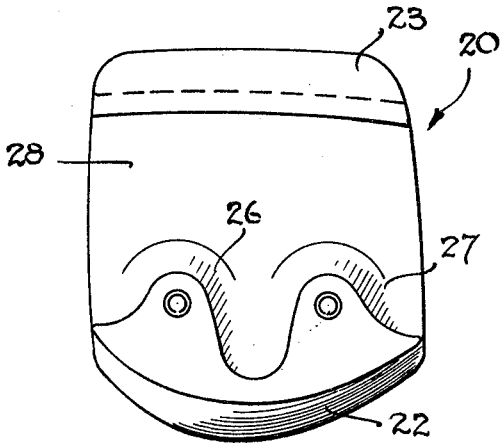
FIG. 6 is a bottom plan view of the cap of the preferred embodiment.

Briefly described, the device of the invention is as follows: The sole plate, face plate, toe, heel, and hosel portions of the club head are cast out of metal as a unitary piece with a four-walled concavity being formed by the inner surfaces of the face plate, sole plate, toe and heel portions of the club head. A cap member preferably formed from wood or plastic has a lip portion which fits under a ledge in the casting running along the top edge of the face plate between the toe and heel portions of the club head. The cap member further has a pair of post portions which extend down from the top thereof and abut against the inside surface of the sole plate, these post portions providing attachment posts for use in attaching the cap member to the casting. The cap member is contoured to mate with the adjacent walls of the casting, and with the casting forms a hollow chamber in the club head.

Referring now to the Figures, a preferred embodiment of the invention is illustrated. The club head comprises a face plate 13, a sole plate 14, toe portion 15, heel portion 16 and hosel portion 12, all cast in a unitary piece 11. Casting 11 may be of a suitable metal such as aluminum. A concavity 18 having an open top opposite surface 14*a* and an open end opposite surface 13*a* is formed between the inner surfaces 13*a*, 14*a*, 15*a* and 16*a* of the face plate, sole plate, toe and heel portions of the casting respectively. Surfaces 15*a* and 16*a* are positioned opposite each other in substantially parallel relationship. Surfaces 13*a* and 14*a* are substantially perpendicular to each other and to surfaces 15*a* and 16*a*. Cap 20 which may be fabricated of wood or plastic is fitted between these inner surfaces to enclose cavity 18, thereby forming a hollow chamber. The outside surfaces 21 and 22 of the cap are curved so that they mate with the adjoining surfaces of the casting to smoothly continue the contours thereof. Side surface 22 is positioned opposite face plate 13. Cap 20 has a lip portion 23 which is offset below surface 21 and which fits under ledge portion 19 of the casting; ledge portion 19 running along the top edge of face plate 13 between front and rear portions 15 and 16 respectively. Cap portion 20 further has a pair of posts 26 and 27 formed therein, which extend from inner surface 28 thereof to the base of the cap portion, these posts abutting against the inner surface 14*a* of the sole plate. Screws 30 and 31 engage post portions 27 and 26 respectively in retaining cap member 20 to the casting with lip portion 23 in abutment against and under ledge portion 19. To more firmly hold the cap member in place, cement may be used. The wall of the cap formed between surfaces 21 and 28 is preferably relatively thin through most of its extent to provide a substantial chamber in the head.

The casting configuration of the invention facilitates a design having a proper weight distribution for optimum balance of the head; i.e., with a balance point along an axis running approximately through the geometric center of the face plate. This results in a fine balanced feel to the club which helps the golfer to attain a better and longer ball flight pattern.

While the invention has been described and illustrated in detail, it is to be clearly understood that this is intended by way of illustration and example only and is not to be taken by way of limitation, the spirit and scope of this invention being limited only by the terms of the following claims.

I claim:

1. A head for a golf club comprising:

a one-piece casting comprising sole plate, face plate, toe and heel portions, each of said portions having an inner surface, said four inner surfaces forming a concavity having an open top opposite the inner surface of said sole plate portion and a substantially fully open end opposite the inner surface of said face plate portion, and a ledge portion running along the top edge of said face plate between the toe and heel portions, a cap having a curved outer top surface and a curved rear surface which smoothly continue the contours of the casting, a lip portion offset below said top surface and extending outwardly along the side of said cap opposite to that on which said rear surface is located, and an inner surface opposite said top surface, said inner and top surfaces defining the top wall of said cap, said cap being fitted between the inner surfaces of said casting with the lip portion thereof under and against the inner surface of the ledge portion of the casting to enclose the concavity, the rear surface of said cap covering the substantially fully open end of said casting and the top surface of said cap covering the open top of said casting, thereby forming a hollow chamber in said club head, and means for firmly securing said cap to said casting.

2. The golf club head of claim 1 wherein the means for firmly securing the cap to the casting comprises a pair of posts formed in said cap and extending from the inner surface thereof to the inner surface of the sole plate portion and means for securing said posts to said sole plate portion.

3. The golf club head of claim 2 wherein said means for securing the posts to the sole plate portion comprises screws.

4. The golf club head of claim 1 wherein the wall formed between the inner and top surfaces of said cap is thin through most of its extent.

5. The golf club head of claim 1 wherein the inner surfaces of said toe and heel portions are positioned opposite each other in substantial parallel relationship, the inner surface of said sole plate portion and the inner surface of said face plate portion being substantially perpendicular to each other and to the inner surfaces of said toe and heel portions.

6. A head for a golf club comprising:

a one-piece casting comprising sole plate, face plate, toe and heel portions, each of said portions having an inner surface, said four inner surfaces forming a concavity having an open top opposite the inner surface of said sole plate portion, a ledge portion running along the top edge of said face plate between the toe and heel portions, the inner surfaces of said toe and heel portions being positioned opposite each other in substantially parallel relationship, a cap having a curved outer top surface and a curved rear surface which smoothly continue the contours of the casting, a lip portion offset below said top surface and extending outwardly along the side of said cap opposite to that on which said rear surface is located, and an inner surface opposite said top surface, said inner and top surfaces defining the top wall of said cap, said cap being fitted between the inner surfaces of said casting with the lip portion thereof under and against the inner surface of the ledge portion to enclose the concavity, thereby forming a hollow chamber in said club head, and means for firmly securing said cap to said casting.

* * * * *